US010090143B2

(12) United States Patent
Gu

(10) Patent No.: US 10,090,143 B2
(45) Date of Patent: Oct. 2, 2018

(54) REAL TIME MEASUREMENT TECHNIQUES COMBINING LIGHT SOURCES AND MASS SPECTROMETER

(71) Applicant: R.J. Reynolds Tobacco Company, Winston-Salem, NC (US)

(72) Inventor: Quanli Gu, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 15/376,989

(22) Filed: Dec. 13, 2016

(65) Prior Publication Data

US 2018/0166269 A1 Jun. 14, 2018

(51) Int. Cl.

| | |
|---|---|
| ***H01J 49/10*** | (2006.01) |
| ***H01J 27/24*** | (2006.01) |
| ***H01J 49/16*** | (2006.01) |
| ***H01J 49/04*** | (2006.01) |
| ***H01J 49/40*** | (2006.01) |
| ***H01J 49/02*** | (2006.01) |
| ***H01J 49/00*** | (2006.01) |

(52) U.S. Cl.

CPC ..... *H01J 49/161* (2013.01); *H01J 49/0031* (2013.01); *H01J 49/025* (2013.01); *H01J 49/0404* (2013.01); *H01J 49/0422* (2013.01); *H01J 49/40* (2013.01)

(58) Field of Classification Search

CPC ..... H01J 49/162; H01J 49/10; H01J 49/0059; H01J 49/142; H01J 27/24; G01N 27/622; G01N 27/64; G01N 30/12; G01N 30/7206; A61B 5/0075

USPC ..... 250/288, 423 P, 282, 281, 287, 423 R, 250/424

See application file for complete search history.

(56) References Cited

U.S. PATENT DOCUMENTS

| | | | | |
|---|---|---|---|---|
| 4,377,749 A * | 3/1983 | Young | H01J 49/10 | 250/423 P |
| 5,769,791 A * | 6/1998 | Benaron | A61B 5/0084 | 600/473 |
| 5,808,299 A * | 9/1998 | Syage | H01J 49/0422 | 250/282 |
| 6,239,428 B1 * | 5/2001 | Kunz | G01N 27/622 | 250/282 |

(Continued)

OTHER PUBLICATIONS www.chromatographyonline.com/lcgc, Macomber et al., "Polyimide-Coated Capillary Tubing: Key Handling Issues," as printed in LCGC, The Application Notebook, Sep. 2003, p. 72-73.

Adam et al. "Investigation, by Single Photon Ionisation (SPI)-Time-of-Flight Mass Spectrometry (TOFMS), of the Effect of Different Cigarette-Lighting Devices on the Chemical Composition of the First Cigarette Puff," *Anal Bioanal Chem*, 2007, 387 (2) pp. 575-584. (Abstract).

(Continued)

*Primary Examiner* — David A Vanore

(74) *Attorney, Agent, or Firm* — Womble Bond Dickinson (US) LLP

(57) ABSTRACT

The present invention provides a mass spectrometer comprising a sample inlet, an ionization source, a mass analyzer, and an ion detector, wherein the ionization source comprises a photoionization detector lamp. The invention also provides mass spectrometers comprising two photoionization detector lamps. The use of a photoionization detector lamp can provide an increase in the signal of detected compounds as compared to the signal of detected compounds obtained using a comparable mass spectrometer with a conventional electron pumped beam lamp.

27 Claims, 11 Drawing Sheets

(56) References Cited

U.S. PATENT DOCUMENTS

| | | | | |
|---|---|---|---|---|
| 6,630,664 | B1 * | 10/2003 | Syage | H01J 49/107 250/288 |
| 6,835,929 | B2 * | 12/2004 | Finch | H01J 49/045 250/288 |
| 7,726,320 | B2 * | 6/2010 | Robinson | A24F 47/008 131/200 |
| 8,044,346 | B2 * | 10/2011 | Kostiainen | H01J 49/162 250/281 |
| 8,431,889 | B2 * | 4/2013 | Zimmermann | G01N 30/12 250/281 |
| 8,742,363 | B2 * | 6/2014 | Munchmeyer | G01N 27/64 250/423 P |
| 9,153,427 | B2 * | 10/2015 | Goldberg | H01J 65/046 |
| 9,799,500 | B2 * | 10/2017 | Giuliani | H01J 49/0059 |
| 2004/0136872 | A1 * | 7/2004 | Miller | G01N 27/624 422/83 |
| 2004/0256550 | A1 * | 12/2004 | Finch | H01J 49/045 250/288 |
| 2006/0284075 | A1 * | 12/2006 | Bonne | H01J 49/10 250/288 |
| 2014/0096782 | A1 * | 4/2014 | Ampolini | A24F 47/008 131/328 |
| 2015/0059780 | A1 * | 3/2015 | Davis | A24F 47/008 131/328 |
| 2015/0216232 | A1 | 8/2015 | Bless et al. | |

OTHER PUBLICATIONS

Adamson et al., "Assessment of an In Vitro Whole Cigarette Smoke Exposure System: The Borgwaldt RM20S 8-Syringe Smoking Machine," *Chemistry Central Journal*, 2011, 5:50.

Agilent Technologies Technical Report, "Time-of-Flight Mass Spectrometry," Technical Overview, 2011, pp. 1-15.

Heraeus Technical Report, Why is a Good PID Lamp Important?. . . and How to get the Best of It., 2011, 3 pages.

Lockyer et al., "Single Photon Ionisation Mass Spectrometry Using Laser-Generated Vacuum Ultraviolet Photons," *Laser Chem. 17*, Manchester, U.K., 1997, pp. 139-159.

Molex Technical Report, "Polymicro Technologies, Polyimide Coated Fused Silica Capillary Tubing," 2016, 2 pages.

Muhlberger et al., "Single Photon Ionization (SPI) via Incoherent VUV-Excimer Light: Robust and Compact Time-of-Flight Mass Spectrometer for On-Line, Real-Time Process Gas Analysis," *Analytical Chemistry*, 2002, 12 pages.

Patrianakos et al., "Chemical Studies on Tobacco Smoke LXIV. On the Analysis of Aromatic Amines in Cigarette Smoke," *J. Anal Toxicol*, 1979, 3 (4), pp. 150-154.

Zimmermann et al. Presentation: "On-Line Puff Resolved Analysis of E-Cigarette Vapours and Heat-Not-Burn Tobacco Products," CORESTA SSPT 2015, Jeju, South Korea, Oct. 4-8, 2015, 46 pages.

* cited by examiner

REAL TIME MEASUREMENT TECHNIQUES COMBINING LIGHT SOURCES AND MASS SPECTROMETER

FIELD OF THE INVENTION

The present invention relates primarily to a mass spectrometer, and an ultraviolet light source for use therein which are adapted for use, for example, in analyzing compounds in smoke.

BACKGROUND OF THE INVENTION

The term "spectrometry" encompasses various analytical methods for determining the makeup of various chemical compounds and mixtures of compounds. One type of spectrometry is mass spectrometry (MS), which measures the mass-to-charge ratio and abundance of gas phase ions in a sample. In particular, time-of-flight (TOF) mass spectrometry is a useful method for evaluating ions based on a time-separating measurement.

In mass spectrometry, a sample is ionized (e.g., by bombarding it with electrons or by exposing it to high intensity laser light) to generate electrically charged fragments ("ions") of the compounds therein. The charged fragments are then separated according to their mass-charge ratio (m/z). Typically, the separation is conducted by accelerating the ions and subjecting them to an electric or magnetic field. For example, in an electric field, ions accelerate in the direction opposite to their polarities (e.g., positive ions accelerate away from the positive electrode).

Typically, after formation and acceleration of ions, the ions are introduced into a "flight tube" wherein different ions can be separated. The flight tube generally is under vacuum, without an electric field. All ions are passed into the flight tube with the same kinetic energy. It is understood that a sample of different ions, moving in the same direction and having substantially comparable kinetic energies, but having varied masses, will have a corresponding distribution of velocities, in which velocity is inversely proportional to the square root of m/z. Light weight ions with the same amount of energy will travel faster than heavier ions. The ions thus travel at different velocities down the flight tube, with ions of identical mass and charge travelling together in "packets," and the packets becoming better separated from one another as they travel down the flight tube.

The ion packets are then detected, with each packet giving rise to a mass peak. The results are typically displayed as spectra of the relative abundance of detected ions as a function of the mass-to-charge ratio of the ion packets. The atoms or molecules in the sample can then be identified by correlating known masses to the identified masses or through a characteristic fragmentation pattern. Various additional and modified features can be incorporated within spectrophotometers. For example, one or more focusing elements and/or reflectors can be provided to modify the properties of the instrument.

One exemplary use for such instruments is in analyzing smoking products, flavor generators and medicinal inhalers that utilize electrical energy to heat and vaporize volatile materials, or otherwise attempt to provide many of the sensations of smoking, without burning tobacco to any significant degree. See, for example, the various types of aerosol generation devices described, discussed, or referenced in U.S. Pat. No. 7,726,320 to Robinson et al., U.S. patent application Ser. No. 13/826,929, filed Mar. 14, 2013, to Ampolini et al., Ser. No. 14/011,992, filed Aug. 28, 2013, to Davis et al., and Ser. No. 14/170,838, filed Feb. 3, 2014, to Bless et al.; which are incorporated herein by reference in their entireties.

In this regard, certain tobacco products that have employed electrical energy to produce heat for smoke or aerosol formation, and in particular, certain products that have been referred to as electronic cigarette products, have become commercially available throughout the world. Representative products that resemble many of the attributes of traditional types of cigarettes, cigars or pipes have been marketed as ACCORD® by Philip Morris Incorporated; ALPHA™ JOYE 510™ and M4™ by InnoVapor LLC; CIRRUS™ and FLING™ by White Cloud Cigarettes; BLU™ by Lorillard Technologies, Inc.; COHITA™, COLIBRI™, ELITE CLASSIC™, MAGNUM™, PHANTOM™ and SENSE™ by Epuffer® International Inc.; DUOPRO™, STORM™ and VAPORKING® by Electronic Cigarettes, Inc.; EGAR™ by Egar Australia; eGo-C™ and eGo-T™ by Joyetech; ELUSION™ by Elusion UK Ltd; EONSMOKE® by Eonsmoke LLC; FIN™ by FIN Branding Group, LLC; SMOKE® by Green Smoke Inc. USA; GREENARETTE™ by Greenarette LLC; HALLIGAN™, HENDU™, JET™, MAXXQ™, PINK™ and PITBULL™ by Smoke Stik®; HEATBAR™ by Philip Morris International, Inc.; HYDRO IMPERIAL™ and LXE™ from Crown7; LOGIC™ and THE CUBAN™ by LOGIC Technology; LUCI® by Luciano Smokes Inc.; METRO® by Nicotek, LLC; NJOY® and ONEJOY™ by Sottera, Inc.; NO. 7™ by SS Choice LLC; PREMIUM ELECTRONIC CIGARETTE™ by PremiumEstore LLC; RAPP E-MY-STICK™ by Ruyan America, Inc.; RED DRAGON™ by Red Dragon Products, LLC; RUYAN® by Ruyan Group (Holdings) Ltd.; SF® by Smoker Friendly International, LLC; GREEN SMART SMOKER® by The Smart Smoking Electronic Cigarette Company Ltd.; SMOKE ASSIST® by Coastline Products LLC; SMOKING EVERYWHERE® by Smoking Everywhere, Inc.; V2CIGS™ by VMR Products LLC; VAPOR NINE™ by VaporNine LLC; VAPOR4LIFE® by Vapor 4 Life, Inc.; VEPPO™ by E-CigaretteDirect, LLC; VUSE® by R. J. Reynolds Vapor Company; Mistic Menthol product by Mistic Ecigs; and the Vype product by CN Creative Ltd. Yet other electrically powered aerosol delivery devices, and in particular those devices that have been characterized as so-called electronic cigarettes, have been marketed under the tradenames COOLER VISIONS™; DIRECT E-CIG™; DRAGONFLY™; EMIST™; EVERSMOKE™; GAMUCCI®; HYBRID FLAME™; KNIGHT STICKS™; ROYAL BLUES™; SMOKETIP®; SOUTH BEACH SMOKE™.

Additional manufacturers, designers, and/or assignees of components and related technologies that may be employed in aerosol delivery device include Shenzhen Jieshibo Technology of Shenzhen, China; Shenzhen First Union Technology of Shenzhen City, China; Safe Cig of Los Angeles, Calif.; Janty Asia Company of the Philippines; Joyetech Changzhou Electronics of Shenzhen, China; SIS Resources; B2B International Holdings of Dover, Del.; Evolv LLC of OH; Montrade of Bologna, Italy; Shenzhen Bauway Technology of Shenzhen, China; Global Vapor Trademarks Inc. of Pompano Beach, Fla.; Vapor Corp. of Fort Lauderdale, Fla.; Nemtra GMBH of Raschau-Markersbach, Germany, Perrigo L. Co. of Allegan, Mich.; Needs Co., Ltd.; Smokefree Innotec of Las Vegas, Nev.; McNeil AB of Helsingborg, Sweden; Chong Corp; Alexza Pharmaceuticals of Mountain View, Calif.; BLEC, LLC of Charlotte, N.C.; Gaitrend Sarl of Rohrbach-les-Bitche, France; FeelLife Bioscience International of Shenzhen, China; Vishay Electronic BMGH of Selb, Germany; Shenzhen Smaco Technology Ltd. of Shenzhen, China; Vapor Systems International of Boca Raton, Fla.; Exonoid Medical Devices of Israel; Shenzhen Nowotech Electronic of Shenzhen, China; Minilogic Device Corporation of Hong Kong, China; Shenzhen Kontle Electronics of Shenzhen, China, and Fuma International, LLC of Medina, Ohio, and 21st Century Smoke of Beloit, Wis.

The aerosolized compounds delivered from such devices can be evaluated using time of flight mass spectrometry as generally described above. TOF MS instruments are particularly useful in ongoing studies to continuously characterize compounds in sequential puffs of smoke/vapor produced from smoking articles/electronic cigarettes in real time. However, the signal to noise ratio for the analysis of trace amounts of certain compounds found in cigarette smoke and/or electronic cigarette vapor is often relatively low using traditional MS instruments. Accordingly, modifications to traditional MS instruments to allow for enhanced sensitivity for detection of a range of compounds would be desirable.

SUMMARY OF THE INVENTION

The present invention provides a mass spectrometer with one or more modifications, which can, in some embodiments, improve the results obtained therefrom. In particular, although not limited thereto, the modifications can provide for enhanced detection of aerosolized compounds delivered from smoking products, electronic cigarettes, flavor generators, and medicinal inhalers.

In one aspect, a mass spectrometer is provided, comprising a sample inlet, an ionization source, a mass analyzer, and an ion detector, wherein the ionization source comprises a photoionization detector lamp. The nature of the components of the mass spectrometer can vary. In certain embodiments, the mass analyzer comprises a time of flight analyzer.

Using the mass spectrometers described herein, in some embodiments, the detection sensitivity for a given compound is at least 5 times the detection sensitivity for said compound using a comparable mass spectrometer wherein the ion detector comprises an electron beam pumped argon lamp of the same wavelength and same photon energy. In some embodiments, the detection sensitivity for a given compound is between about 5 times and about 30 times the detection sensitivity for said compound using a comparable mass spectrometer wherein the ion detector comprises an electron beam pumped argon lamp of the same wavelength and same photon energy. Further, in some embodiments, the signal to noise ratio is higher than the signal to noise ratio of a comparable mass spectrometer wherein the ion detector comprises an electron beam pumped argon lamp of the same wavelength and same photon energy.

In certain embodiments, a mass spectrometer is provided as described above, further comprising a second ionization source comprising a second photoionization detector lamp. In certain such embodiments, the signal produced from the mass spectrometer is at least two times that produced from a comparable mass spectrometer comprising a single ionization source (e.g., a single photoionization detector lamp).

The photoionization detector lamp(s) can, in some embodiments, emit vacuum ultraviolet radiation. For example, in certain embodiments, the photoionization detector lamp(s) are krypton discharge lamps. The photoionization detector lamp(s) may, for example, have a photon energy of between about 10 and about 11 eV. In some embodiments, the mass spectrometer may further comprise a MgF2 window through which radiation from the photoionization lamp(s) pass. The photoionization detector lamp(s) themselves can, in some embodiments, comprise a $MgF_2$ window through which radiation from the photoionization detector lamp passes. The lamps can be associated with the remaining features of the spectrometer in various fashions. For example, the photoionization lamp(s) m in certain embodiments, the lamp(s) are within a vacuum environment or are not within a vacuum environment. In one particular embodiment, a mass spectrometer comprising two photoionization lamps is provided, wherein one photoionization detector lamp is within a vacuum environment and wherein one photoionization detector lamp is not within a vacuum environment.

The mass spectrometers designed herein can be used together with one or more additional types of instruments. For example, in certain embodiments, a mass spectrometer can further comprise a smoking instrument in-line with the spectrometer, wherein smoke or vapor produced within the smoking instrument is in fluid communication with the sample inlet of the mass spectrometer.

In another aspect of the invention, a method of analyzing aerosolized or vaporized compounds is provided, comprising: providing a sample in gaseous form; introducing the sample in gaseous form into a mass spectrometer comprising a sample inlet, an ionization source, a mass analyzer, and an ion detector, wherein the ionization source comprises a photoionization detector lamp; and detecting the presence of one or more compounds in the sample based on output from the ion detector. In some embodiments, the aerosolized or vaporized compounds are produced from a smoking article or electronic smoking article. In some embodiments, such compounds comprise compounds selected from the group consisting of nicotine and organic acids (e.g., levulinic acid).

BRIEF DESCRIPTION OF THE DRAWINGS

In order to provide an understanding of embodiments of the invention, reference is made to the appended drawings, which are not necessarily drawn to scale, and in which reference numerals refer to components of exemplary embodiments of the invention. The drawings are exemplary only, and should not be construed as limiting the invention.

DETAILED DESCRIPTION OF THE PREFERRED EMBODIMENTS

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise.

Figure 1:
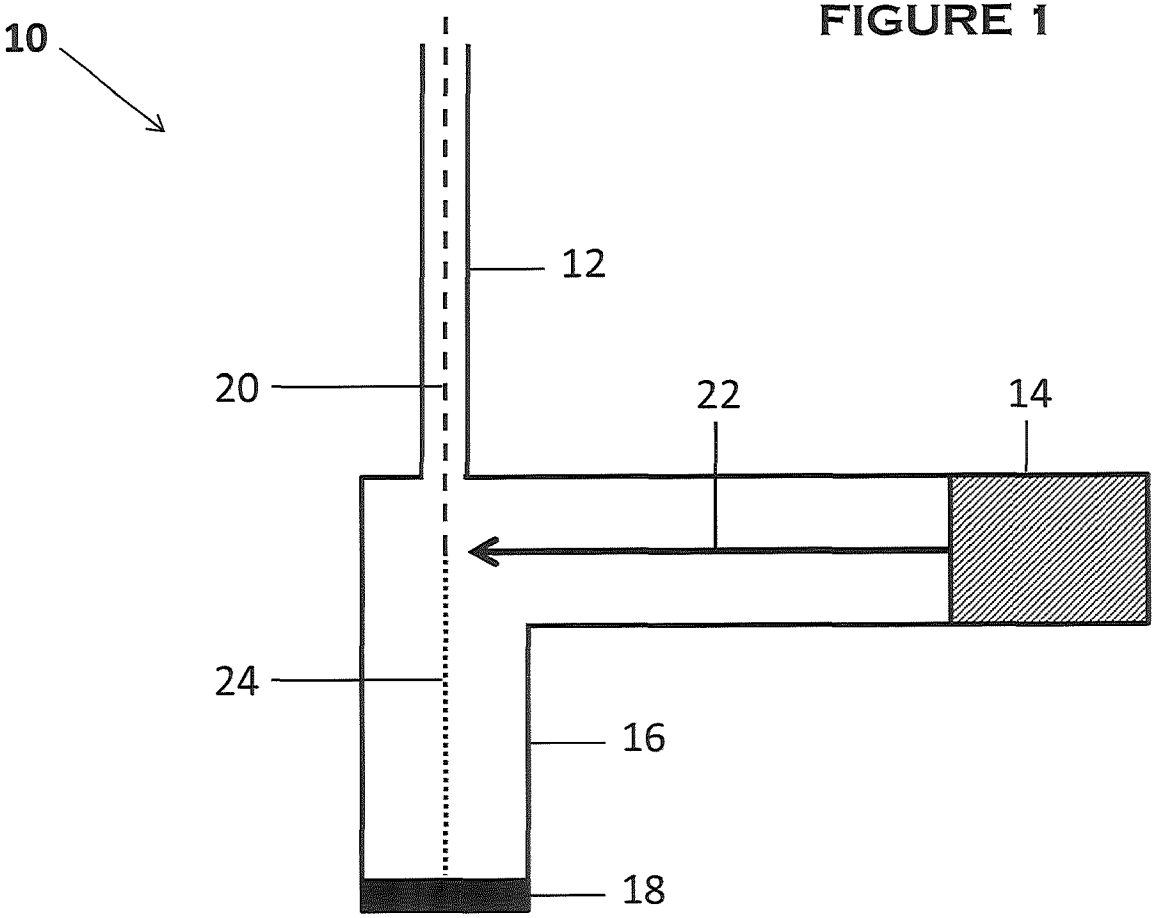
FIG. 1 is a schematic drawing of a mass spectrometer.

Generally, the invention provides a mass spectrometer, wherein certain features are generally depicted in FIG. 1. Mass spectrometers 10 are generally understood to comprise components including a sample inlet 12, an ionization source 14, a mass analyzer 16, and an ion detector 18. In particular embodiments, the mass analyzer comprises a time of flight (TOF) mass analyzer (providing a TOF mass spectrometer). A sample 20 is introduced through the sample inlet 12 and the ionization source 14 provides a means 22 for converting at least a portion of the components of sample 20 to ionic forms 24.

Figure 3B:
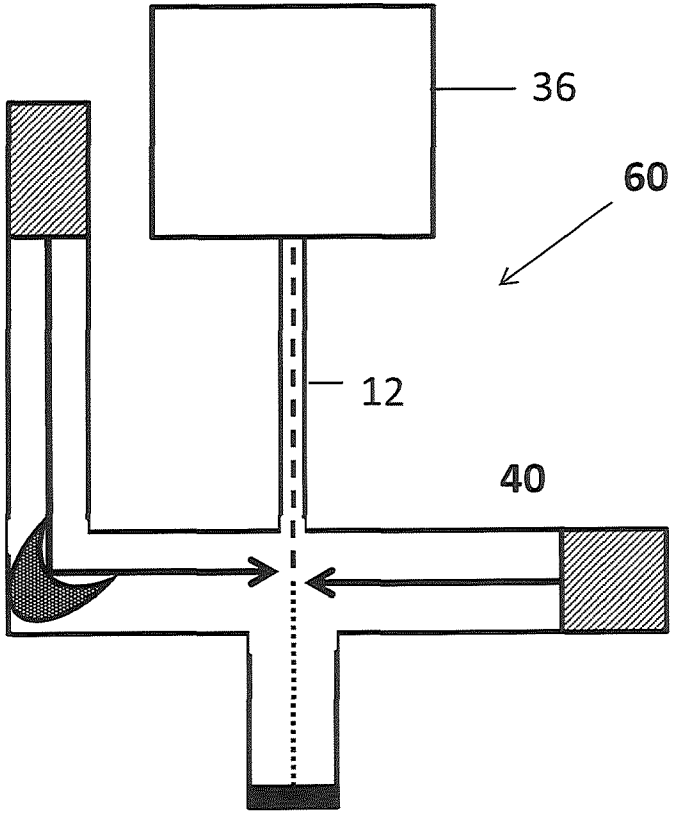
FIGS. 3A and 3B are schematic drawings of systems employing a smoking machine in line with the mass spectrometers of FIGS. 1 and 2, respectively.
Figure 3A:
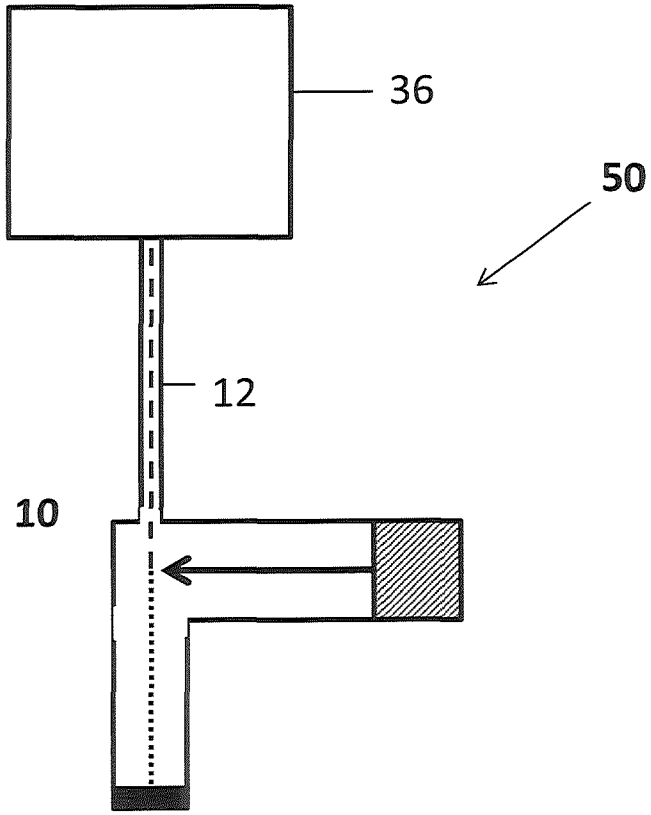

The design of the spectrometer described herein varies in one or more ways from a traditional mass spectrometer, as will be described in greater detail below. Traditional mass spectrometers (e.g., TOF mass spectrometers) are known and available from various manufacturers including, but not limited to, Agilent Technologies (U.S.A.), BioMerieux SA (France), Borgwaldt-KC (Germany), Bruker Corporation (Germany), JEOL, Inc. (Japan), LECO Corporation (U.S.A.), Markes International Ltd. (United Kingdom), Perkin-Elmer (U.S.A.), Shimadzu Corporation (Japan), Thermal Scientific, Inc. (U.S.A.) and Waters Corporation (U.S.A.). Advantageously, in certain embodiments, mass spectrometers can adapted for in-line use with one or more instruments or sample sources. For example, in certain embodiments, the mass spectrometers described herein can be used in-line with a smoking instrument (designed to withdraw a given amount of smoke or vapor from a cigarette or electronic cigarette and introduce it into the mass spectrometer at regular intervals, e.g., to mimic typical puff volumes and frequency). Such systems are depicted in FIGS. 3A and 3B as systems 50 and 60, respectively, wherein the mass spectrometer 10 or 40 is coupled (e.g., in line) with smoking instrument 36 via sample inlet 12.

The specific types of mass spectrometers to which the features described herein are applicable can vary. For example, the ionization source 14 can very. Generally, an ionization source is a device that creates atomic and/or molecular ions. Various methods for ionizing samples are known and can be used to create ions within a mass spectrometer, including but not limited to, glow discharge (GD), electron impact ionization (EI), chemical ionization (CI) (including atmospheric pressure chemical ionization (APCI)), photo ionization (PI), field ionization (FI), inductively coupled plasma (ICP), fast atom bombardment (FAB), thermospray (TSI), ionspray (IS), electrospray (ESI), plasma desorption (PD), laser desorption (LD), and/or matrix-assisted laser desorption/ionization (MALDI).

For the analysis of complex organic mixtures, "softer" ionization techniques may be desirable, which provide less fragmentation than other techniques (and which can provide for detection of substantially only intact molecules). Additionally, in certain embodiments, selective ionization techniques are desirable (wherein only compounds with an ionization energy within a given range are ionized). In such embodiments, only the molecular or parent ion may be advantageously obtained for mass analysis. For example, in certain preferred embodiments, as described herein, the ionization source is a photoionization source, wherein ions are formed by the interaction of a photon with a sample. Photoionization may be multi-photon ionization (MPI, wherein several photons can be absorbed an atom/molecule and their energies may be combined to produce an ion therefrom) or single photon ionization (SPI, wherein a photon having an energy greater than the ionization energy of a compound in a sample can be absorbed, resulting in ionization that compound). Certain exemplary ionization sources described herein are SPI sources, e.g., which function via single photon ionization with vacuum ultraviolet (VUV) light, as will be described in greater detail herein.

Generally, mass analyzers 16 measure the m/z ratio and include, but are not limited to, time of flight (TOF) analyzers, quadrupoles, quadrupole ion traps, quadrupole-TOF analyzers, time of flight reflectron analyzers, and ion cyclotron resonance mass analyzers. Although the mass analyzer can vary, in preferred embodiments, a TOF mass analyzer is employed. Although the disclosure is not intended to be limiting, the present invention will be described with particular reference to TOF mass spectrometers for convenience. It is to be understood that, in certain embodiments, the features described herein may be applicable to mass spectrometers employing other mass analyzers, such as those listed above.

Various modifications to traditional MS instruments are provided herein. In one embodiment, a mass spectrometer (e.g., a TOF mass spectrometer) having an ionization source 14 comprising a photoionization detector ("PID") lamp is provided. In one embodiment, a mass spectrometer (e.g., a TOF mass spectrometer) wherein the sample inlet 12 comprises an alternative type of capillary for the introduction of the sample to be evaluated is provided. In one embodiment, a mass spectrometer (e.g., a TOF mass spectrometer) having an ionization source comprising two lamps is provided (wherein one or both lamps may be a PID lamp). In some embodiments, two or more of these features are combined in a single instrument. For example, in one embodiment, a TOF mass spectrometer wherein the sample inlet 12 comprises an alternative type of capillary and wherein the ionization source 14 comprises a PID lamp is provided. In another embodiment, a TOF mass spectrometer wherein the sample inlet 12 comprises an alternative type of capillary and wherein the ionization source 14 comprises two PID lamps is provided.

The mass spectrometers described herein generally can be used for the analysis of any type of sample. The type of sample may depend upon the type of ionization source. For example, in MALDI mass spectrometry, a sample is generally ionized from solid form. However, with other ionization sources, samples are generally ionized from liquid or gas/vapor form and thus are introduced into a mass spectrometer in such a form. Furthermore, various analytical techniques can, in some cases, be employed in combination with mass spectrometry. For example, chromatographic techniques (e.g., gas chromatography or liquid chromatography) can be used to separate samples into their constituent compounds and the stream of separated compounds can then be fed directly into a mass spectrometer (typically in gas or liquid form, respectively).

Mass spectrometry can be used in a qualitative and/or quantitative manner. Mass spectrometers can be used to identify unknown compounds, determine the isotopic composition of certain elements within compounds, and to determine the structure of a compound (based on its fragmentation pattern). Mass spectrometers can also be used to quantify the amount of compound in a sample. Mass spectrometers are widely used to evaluate various compounds and compound mixtures, including but not limited to, volatile organic compounds, peptides, proteins, carbohydrates, peptides, and nucleotides. The remainder of the disclosure and the examples will focus on use of the mass spectrometers specifically in the context of analyzing compounds released from smoking articles and electronic smoking articles. It is noted that the designs described herein, however, can be similarly useful in providing the noted benefits with regard to a wide range of samples and the disclosure is accordingly not limited to use of the mass spectrometer designs to analyze smoking article and electronic smoking article analysis.

As noted above, in certain embodiments, a mass spectrometer having an ionization source comprising a PID lamp is provided according to the present disclosure. Generally, PID lamps are gas discharge lamps that are driven in DC or RF mode. These lamps are essentially small discharge tubes filled with a desired gas. Some such lamps comprise an exit window comprising a suitable material to transmit the vacuum ultra-violet protons required for photoionization of the sample to be analyzed. Advantageously, for use in the instruments described herein, a stable, long-lived glow discharge lamp functioning in the vacuum ultraviolet (VUV) is employed. PIDs can be tailored by selection of window material and/or filling gas to give the desired photons. In some embodiments according to the present disclosure, the window material is magnesium fluoride and/or in some embodiments, the filling gas comprises Krypton (e.g., 99+% Krypton gas). In one specific embodiment, a PID lamp with discharge energy per photon between about 10 eV and about 11 eV (e.g., 10.6 or 10.8 eV) is employed.

Such lamps can be internally assembled outside or within the instrument, for example, by providing a discharge tube filled with the desired gas and, optionally, associating the discharge tube with a window. The connection between the discharge tube, the optional window, and the mass spectrometer can vary and may, in some embodiments, be a direct connection, whereas in other embodiments, may be facilitated by an o-ring or other sealing component. In certain embodiments, pre-assembled PID lamps are utilized. PID lamps are commercially available, for example, from Andrew Glass Company (N.J., U.S.A.). Other commercial manufacturers and suppliers of PID lamps include, but are not limited to, Excelitas Technologies (U.S.A.), Heraeus Noblelight GmbH (Germany), RAE Systems (U.S.A.), Resonance Ltd. (Canada), Sigma-Aldrich (U.S.A.), and Vitro Technology, Ltd. (U.S.A).

In certain embodiments, a PID lamp as described herein is used to replace the standard electron beam pumped lamp (e.g., argon lamp) commonly used as an ionization source in conventional mass spectrometers (e.g., TOF mass spectrometers). It is noted that, in some embodiments, replacement of an electron beam pumped lamp in a conventional mass spectrometer with a PID lamp as described herein may require modification of various features of the commercial instrument to allow the PID lamp to interface with the commercial instrument. For example, incorporation of a PID lamp within a commercial TOF mass spectrometer may utilize one or more vacuum adaptors, flanges, o-rings, and/or power supplies. Various adjustments may be necessary, including, but not limited to, aligning the elliptical focusing mirror to maximize the signal.

When an appropriate interface between a PID lamp and the remaining portion of a mass spectrometer is provided, a significant increase in detection sensitivity can be achieved as compared with a comparable mass spectrometer employing an electron beam pumped lamp for ionization (wherein the electron beam pumped lamp has a comparable emission wavelength and energy per photon). For example, in certain embodiments, the detection sensitivity can be increased by at least a factor of 5, at least a factor of 10, at least a factor of 15, or at least a factor of 20 for a PID lamp as compared with an electron beam pumped lamp of the same wavelength and same energy per photon (in eV). A representative study presenting this increase in detection sensitivity for a MS TOF instrument is provided in Example 1, below. It is noted that the means by which the PID lamp is associated with the mass spectrometer may impact the increase in detection sensitivity. For example, a PID lamp associated with an instrument wherein the PID lamp comprises a $MgF_2$ window can exhibit a greater signal improvement (over a typical electron beam pumped lamp) than a PID lamp associated with an instrument wherein the PID lamp lacks a $MgF_2$ window and is sealed by an o-ring directly to the instrument.

In another embodiment, a mass spectrometer is adapted to modify the sample inlet 12 with alternative capillary tubing. In certain embodiments, capillary tubing is used as the transfer line to bring the species to be analyzed (containing aerosol/gas phase molecules) into a high vacuum chamber where the molecules are ionized and then detected. Commercial capillary tubing is made of fused silica and ideally does not influence the aerosol or gas phase molecules passing therethrough. In particular, the interior coating of the capillary tubing should not interact with the molecules passing therethrough to modify the separation efficacy and the molecules should not undergo any degree of deposition on the interior coating or decomposition within the tubing.

The "alternative" capillary referred to herein is a capillary that replaces the commercial capillary tube that is typically provided with the purchase of the mass spectrometer. For example, one representative capillary that is commonly provided with the purchase of a mass spectrometer is a Borgwaldt-KC capillary. In one embodiment, the "alternative" capillary is a capillary with polyimide coating. The polyimide coating thickness can vary and in some embodiments, may be between about 10 and about 25 micro. The inner diameter can vary and, in one embodiment, can be about 150 to about 250 micro, e.g., about 175 to about 225 micro, such as about 200 micro. Advantageously, in various embodiments, the "alternative" capillary is operable up to temperatures up to about 300° C. or up to about 350° C.

When analyzing puffs from an electronic cigarette using a TOF MS instrument, one would expect to see a peak for nicotine ion (162 amu). It is noted that, using an instrument with sample inlet 12 comprising the standard capillary tubing, this nicotine ion peak is observed; however, as the temperature of the capillary is increased, a nicotine fragmentation peak appears (158 amu) and as the temperature is increased, this fragmentation peak becomes a more significant peak. In contrast, using an instrument with sample inlet 12 comprising alternative capillary tubing, the nicotine ion peak is observed, with little to no fragmentation signal at 158 amu, even at elevated temperatures. See Example 2 for further discussion of such studies. Accordingly, the alternative capillary described herein can provide for a beneficial decrease fragmentation of certain ions of interest (e.g., nicotine ions), particularly when the capillary is maintained at elevated temperatures (e.g., greater than about 240° C. or greater than about 250° C., such as within the range of about 225° C. to 260° C.).

Additionally, the transfer valve through which the sample passes into the mass spectrometer may be at an elevated temperature, which can affect the resulting spectra obtained from the instrument. In particular, puff broadening is reduced in an instrument with sample inlet 12 comprising the alternative capillary tubing as compared with that in an instrument with sample inlet 12 comprising the standard capillary tubing. At temperatures as high as 170° C., puff broadening associated with increases in transfer valve temperature commonly seen with the standard capillary can be effectively minimized using the alternative capillary tubing. Relative signal increases for both nicotine and glycerin can be observed in certain embodiments employing the alternative capillary as compared with embodiments employing the standard capillary. For example, in certain embodiments, an increase of from about 50-70% in nicotine signal is observed with the alternative capillary as compared with the standard capillary.

When an alternative type of capillary tubing comprising a polyimide coating is employed, various advantages as compared with the standard capillary tubing are observed. For example, a number of improved spectral features are demonstrated including, but not limited to, a decrease (including elimination) of the undesirable nicotine decomposition/fragmentation peak at 158 amu, particularly at elevated capillary temperatures (e.g., greater than 225° C., greater than 240° C. or greater than 250° C., such as between about 225° C. to 260° C.); a general increase in the parent nicotine signal (e.g., at least an 80% signal increase for nicotine), and a decrease in (e.g., almost complete elimination of) puff broadenings observed, particularly at elevated temperatures of the transfer valve (e.g., greater than 100° C., greater than 120° C., or greater than 150° C.). With regard to sample inlet 12, the replacement of the standard capillary with an alternative capillary as described herein can improve the signal obtained from a TOF MS instrument by at least 1.5 times. Such alternative capillary tubings can vary; one exemplary tubing that exhibited the enhancements described herein is available from Polymicro Technologies (Ariz., USA) with an inner diameter of 200±06 micrometers, outer diameter 360±06 micrometers, and polyimide coating thickness of 18 micrometers.

In certain embodiments, a mass spectrometer comprising two or more ionization sources is provided. In particular embodiments, a mass spectrometer (e.g., a TOF mass spectrometer) comprising two ionization sources (e.g., two lamps) is provided (referred to herein as a "dual lamp mass spectrometer"). Generally, a dual lamp spectrometer employs two lamps capable of ionizing sample 20 into ions 24, wherein one or both of the lamps can be a PID lamp as described above.

Figure 2:
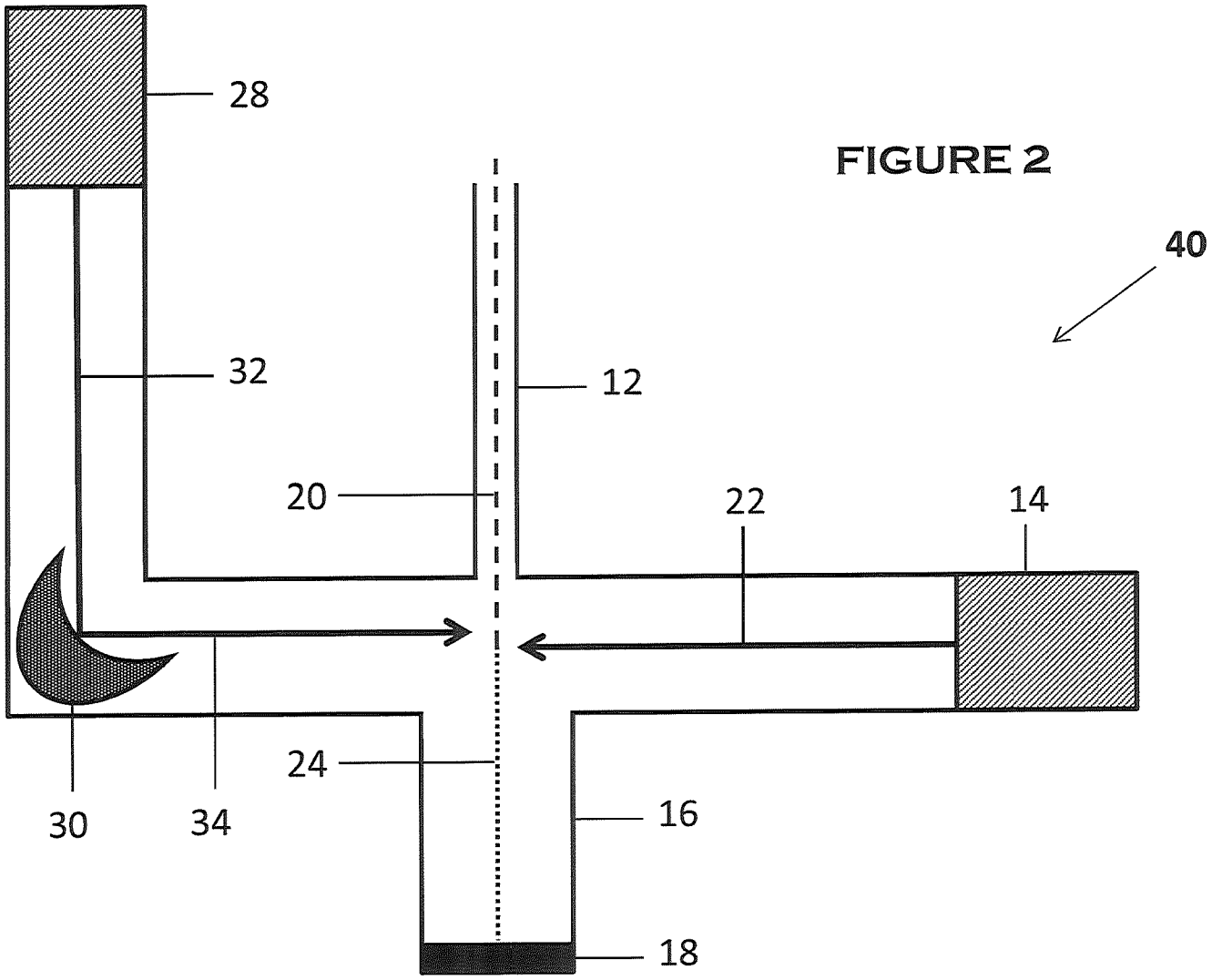
FIG. 2 is a schematic drawing of a mass spectrometer employing two lamps.

The two lamps of a dual lamp mass spectrometer can be arranged in various fashions. One exemplary embodiment is represented in FIG. 2. In the mass spectrometer shown in FIG. 2, ionization sources 14 and 28 are provided such that the direct emissions therefrom (22 and 32) are at right angles to one another. Emission 32 is reflected using a reflector 30 to provide emission 34 that is parallel to emission 22. The reflector 30 can be any reflector (e.g., mirror) sufficient to reflect the incident emission 32 in the desired direction. It is understood that the reflector can be straight or curved, wherein the angle or curvature at which the incident emission contacts reflector 30 can be varied to modify the angle of emission 34 to achieve the desired orientation thereof. In some embodiments, reflector 30 comprises a mirror with feedthrough adjust. Advantageously, the emissions produced from the two ionization sources are parallel with respect to one another when they comes into contact with sample 20, but horizontally displaced with respect to one another (as shown in FIG. 2, wherein the emission from ionization source 28 is slightly above that from ionization source 14 at the point of contact with sample 20). The two ionization sources are generally disposed such that their emissions contact sample 20 from different sides of the sample. For example, in some embodiments, the emissions at the point of contact with sample 20 are roughly 180 degrees with respect to one another.

In certain embodiments (e.g., as depicted in FIG. 2), one or both ionization sources 14 and 28 are PID lamps as described above. Advantageously, the use of two lamps can lead to improved signal. For example, in some embodiments, the use of two PID lamps (e.g., two identical PID lamps) can improve the signal by at least 1.5 times or at least 2 times that obtained using a single such PID lamp (e.g., between about 1.5 times and about 3 times or between about 1.5 times and about 2 times). Although in certain embodiments, including those described in Example 3, below, the PID lamps employed in the dual lamp mass spectrometer emit the same wavelength with the same photon energy, it is noted that it may be advantageous in certain embodiments to use PID lamps having different wavelengths and/or different power (e.g., to detect a broader range of chemical species).

As noted above with respect to a spectrometer modified to incorporate a single PID lamp, in certain embodiments, various features of the commercial instrument may be modified to allow one or both of the PID lamps in a dual lamp system to interface with the commercial instrument (e.g., using one or more types of vacuum adaptors, flanges, o-rings, and/or power supplies). Various adjustments may be necessary, including, but not limited to, aligning the elliptical focusing mirror to maximize the signal.

Where two PID lamps are incorporated within an instrument, in order to achieve the highest signal, the interface of one PID lamp with the instrument may not be the same as that of the other PID lamp with the instrument. For example, in one particular embodiment, ionization source 14 is a PID lamp comprising a $MgF_2$ lens window through which the emission passes prior to contacting the sample and ionization source 28 is a PID lamp that is sealed to the instrument (e.g., via an o-ring) without a $MgF_2$ lens window through which the emission passes.

As noted, the improvements described herein can, in some embodiments, be combined. For example, in one embodiment, a TOF mass spectrometer is modified such that sample inlet comprises an alternative type of capillary and two ionization sources comprising two PID lamps are provided. In such embodiment, the sensitivity of detection can be dramatically increased, e.g., at least 40 times as sensitive or at least 50 times as sensitive (e.g., between about 40 and about 60 times as sensitive) as a comparable TOF mass spectrometer wherein the sample inlet comprises a standard capillary and wherein only one ionization source, comprising an electron beam pumped lamp is provided (comparing lamps having the same emission wavelengths and photon energy).

As previously noted, in certain embodiments, the mass spectrometers described herein are well suited for analysis of compounds released from smoking articles and electronic smoking articles. In particular embodiments, the mass spectrometers described herein can be used to analyze nicotine and/or organic acids (e.g., including, but not limited to, levulinic acid and lactic acid) present in the smoking articles and electronic smoking articles. In certain embodiments, the instruments can provide better signals and/or better signal to noise ratios with respect to nicotine, organic acids, and other compounds.

EXPERIMENTAL SECTION

All Examples are conducted using a TOF-MS instrument from Borgwaldt-KC, coupled with a standard smoking machine. Where the smoking machine is employed, electronic cigarettes are inserted into a vented hood of the smoking machine and a syringe pump is used to withdraw a set amount of volume. The puff profile and smoking frequency are preset and controlled by a step motor associated with the smoking machine. The TOF-MS instrument is used to detect aerosolized and/or vaporized compounds produced from the puffing.

Example 1

Figure 4B:
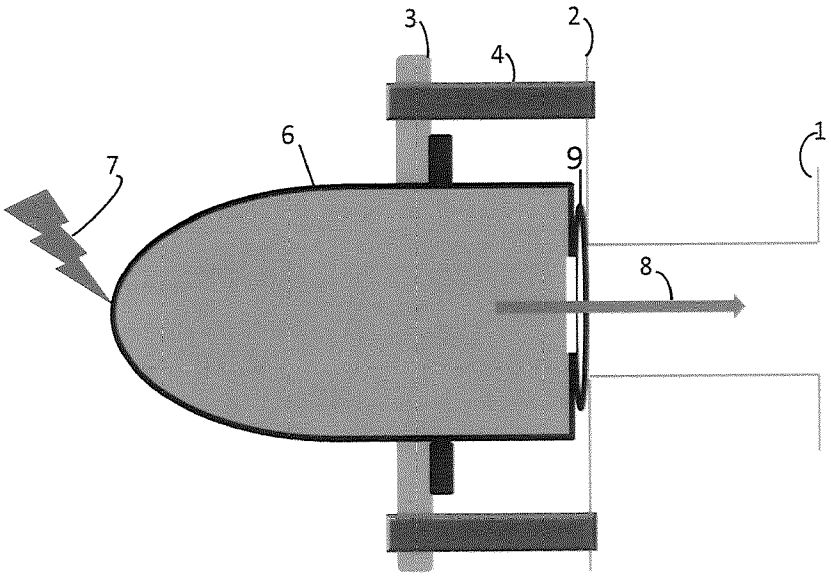
FIGS. 4A and 4B are representative photoionization detector (PID) lamps employed in certain mass spectrometers described herein.
Figure 4A:
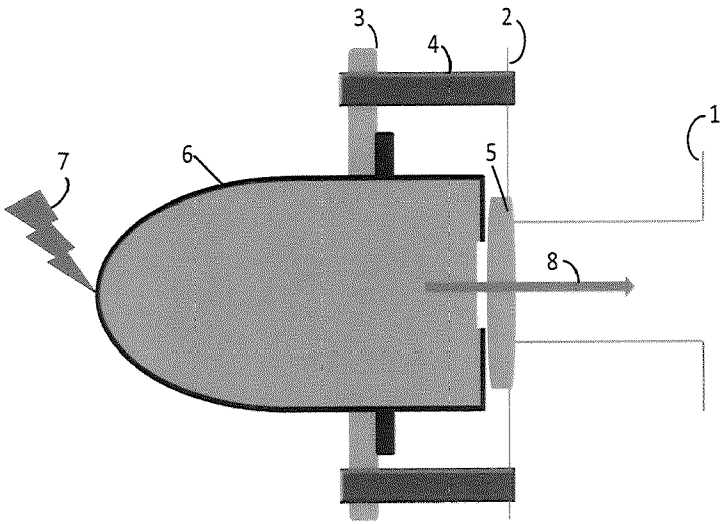

To evaluate the effect of replacing a traditional lamp with a PID lamp, krypton discharge PID lamps were assembled and associated with the TOF spectrometer instrument in various ways. Two such ways wherein a PID lamp and its holders are interfaced with a high vacuum flange from the instrument are shown in FIGS. 4A and 4B. In FIG. 4A, a magnesium fluoride window 5 is associated with lamp 6 and is attached to an ASA flange 2. Another ASA flange 3 holding the lamp (6) is attached to the magnesium fluoride window. Nuts 4 hold the assembly together. A voltage connector 7 is associated with the unit and VUV emission 8 is produced and passes through the window into the instrument, which is connected via a flange 1. In FIG. 4B, this design is slightly modified by removal of the magnesium fluoride window 5; in its place is an O-ring 9, directly connecting the discharge lamp to the grooved ASA flange 2. After an overnight pumping, the ion chamber in this arrangement was able to maintain a vacuum pressure of $3.9\times10^{-7}$ torr.

Figure 4C:
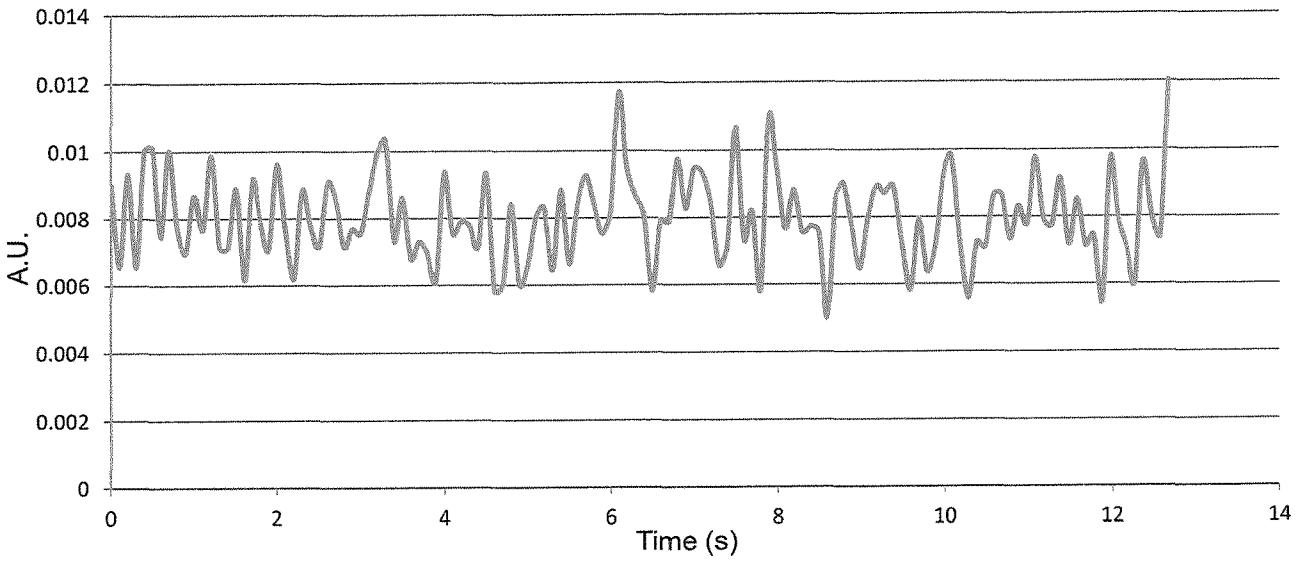
FIGS. 4C and 4D are spectra showing toluene signals obtained from mass spectrometers employing the PID lamps of FIGS. 4A and 4B, respectively.
Figure 4D:
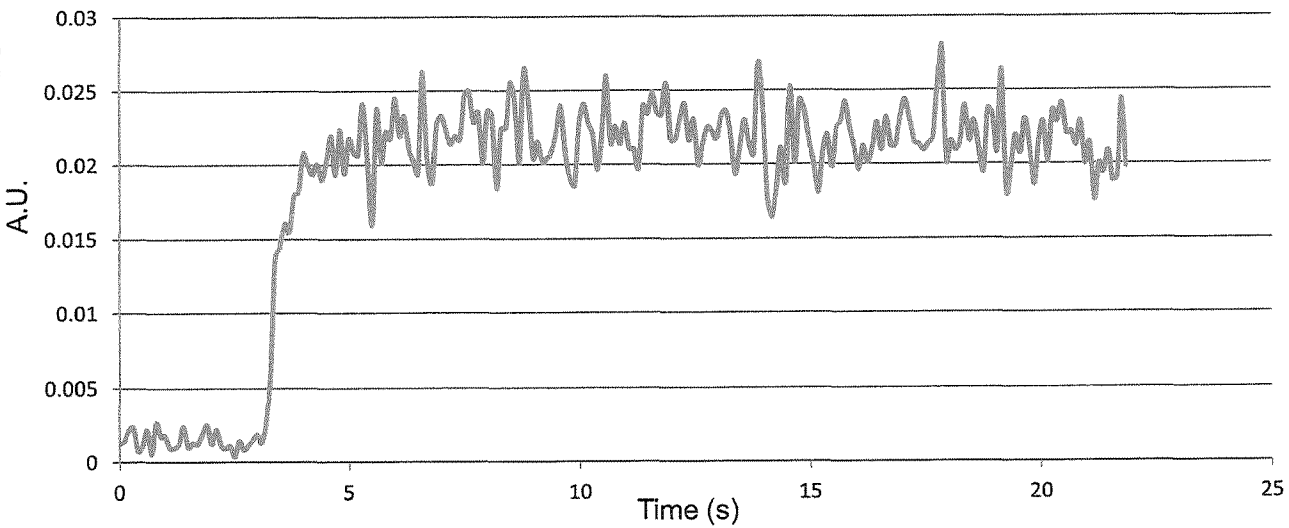

The signal levels of these two configurations are compared in FIGS. 4C and 4D, which provide signal data over time for 100 ppm toluene gas in $N_2$ using an ionization source comprising a PID lamp as depicted in FIGS. 4A and 4B, respectively. In these graphs, the y axis represents the relative signal level of the toluene ion and the x axis represents time (in seconds). As shown, the PID lamp configuration of FIG. 4B provided for a higher overall signal (about three fold higher than that for the configuration of FIG. 4A). It is believed that, in this configuration, the lamp surface is in such a high vacuum that it is kept in a much cleaner environment and the emitted light gets focused onto the ionization region with minimal reduction. However, with this embodiment, a vacuum chamber generally has to be vented to replace the lamp, as the seal between the lamp 6 and the flange 2 is important to proper operation.

Although not intending to be limited by theory, it is believed that the increased signal associated with the configuration shown in FIG. 4B may result from the absorption of UV light from the air. Both the configurations of FIGS. 4A and 4B are useful and provide improved spectra in comparison configurations employing an electron beam pumped lamp of analogous wavelength and photon energy. One of the advantages of the configuration shown in FIG. 4A is that the lamp is housed in air, so it can be removed without affecting the instrument (and there is no need to vent the vacuum chamber). Typically, a purging gas is implemented in such embodiments to allow for maximal light to pass through the magnesium fluoride window. The configuration of FIG. 4B delivers more sensitivity, but requires careful control to ensure that the seal between the lamp and the flange is maintained.

Figure 5:
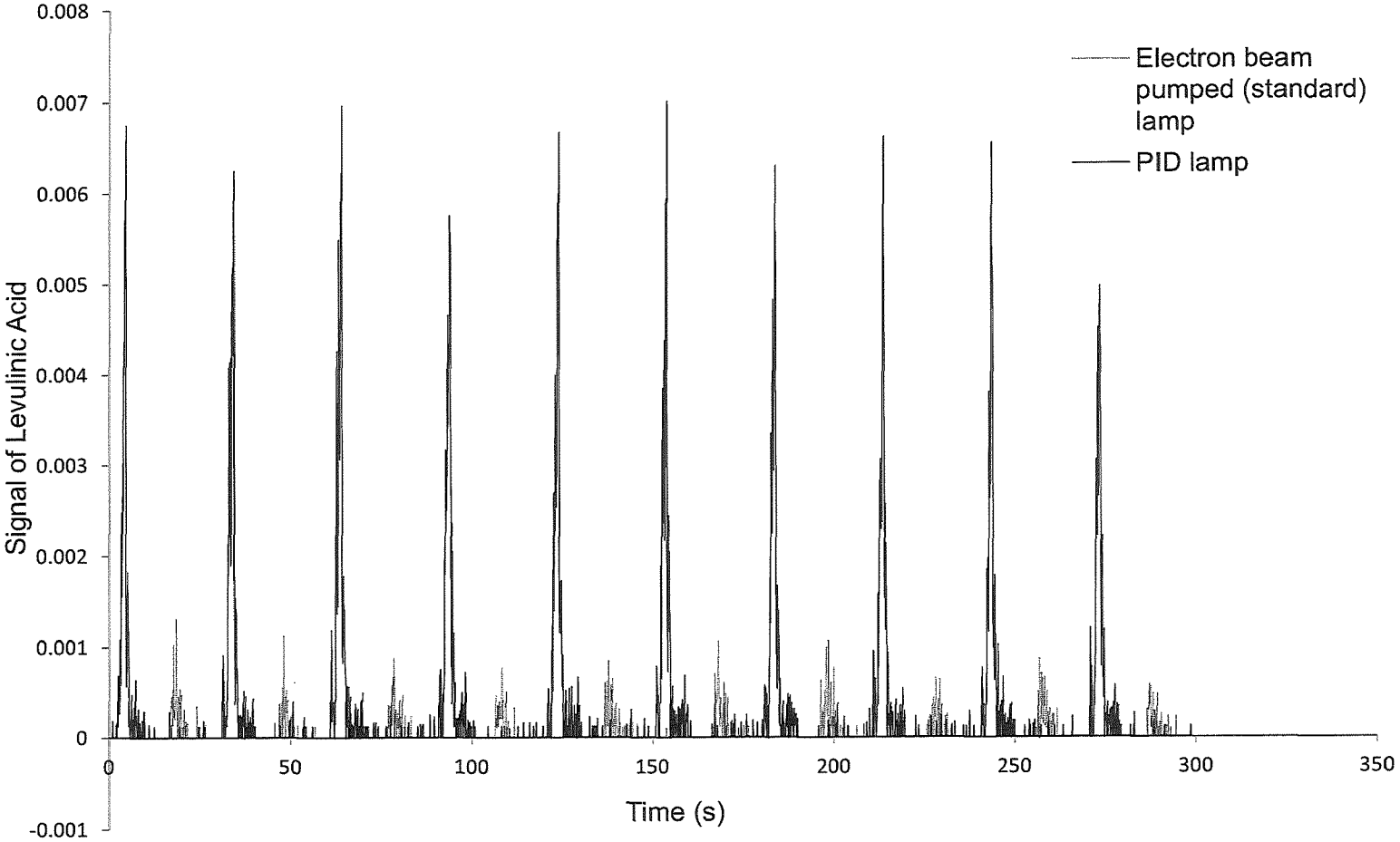
FIG. 5 is a graph comparing levulinic acid signals obtained from repeated puffs from an electronic cigarette on a traditional mass spectrometer and a mass spectrometer employing a PID lamp.

The configuration shown in FIG. 4A was further studied to compare the levulinic acid levels from an e-cigarette as analyzed by a TOF mass spectrometer and detected by the PID lamp of FIG. 4A to the levulinic acid levels from an e-cigarette as analyzed by a TOF mass spectrometer and detected by a standard electron beam lamp. E-cigarettes were smoked ten puffs and the results are provided in FIG. 5, where the y axis represents the signal of levulinic acid in the puffs and the x axis represents time (in seconds). As shown, the sensitivity using a detector comprising the PID lamp of FIG. 4A is enhanced by at least a factor of 7 and the puffing time profile and signal to noise ratio are also improved as compared with a detector based on a standard electron bean lamp.

Instrument sensitivity and stability for nicotine and levulinic acid using the detector based on the PID lamp of FIG. 4A were studied by analyzing the changes of the relative amount of nicotine and levulinic acid from 10 consecutive puffs from an e-cigarette. Using the standard electron beam lamp, levulinic acid had around a 50% variation in signal intensity across the 10 puffs and nicotine had about a 10% variation in signal intensity across the 10 puffs. Using the PID lamp of FIG. 4A in place of the standard electron bean lamp, both levulinic acid and nicotine had about a 10% variation in signal intensity across the 10 puffs. Further, the detection sensitivity of levulinic acid (typically in trace amounts in certain electronic cigarettes) using the PID lamp is increased relative to that using the standard electron beam lamp. With regard to both nicotine and levulinic acid, the stability (i.e., spectrum reproducibility from puff to puff) of the instrument comprising the PID lamp is high (with signal variation of about 10% or below), whereas the stability of the instrument comprising a standard electron beam lamp is much lower (with levulinic acid exhibiting a much larger signal variation, around 50%, believed to be due at least in part to the low detection sensitivity of levulinic acid).

Example 2

To evaluate the effects of a new capillary tubing, tubing was purchased with inner diameter of 200±06 microns and outer diameter of 360±10 microns, with polyimide coating thickness of 18 microns and results employing this capillary tubing are compared against results employing the commercial (standard) capillary. After each puff on an electronic cigarette, the vapor passes through a heated capillary (either a standard capillary or the alternative capillary referenced herein) into the vacuum chamber, where it is contacted with the PID lamp described in Example 1.

Figure 6A:
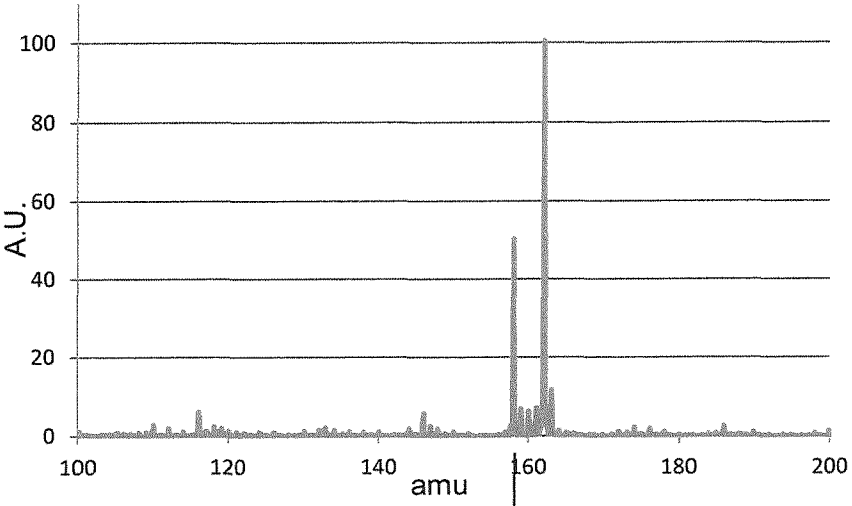
FIGS. 6A and 6B compare the nicotine signal obtained from a puff from an electronic cigarette, on a traditional instrument (A) and on an instrument containing an alternative capillary tube (B)
Figure 6B:
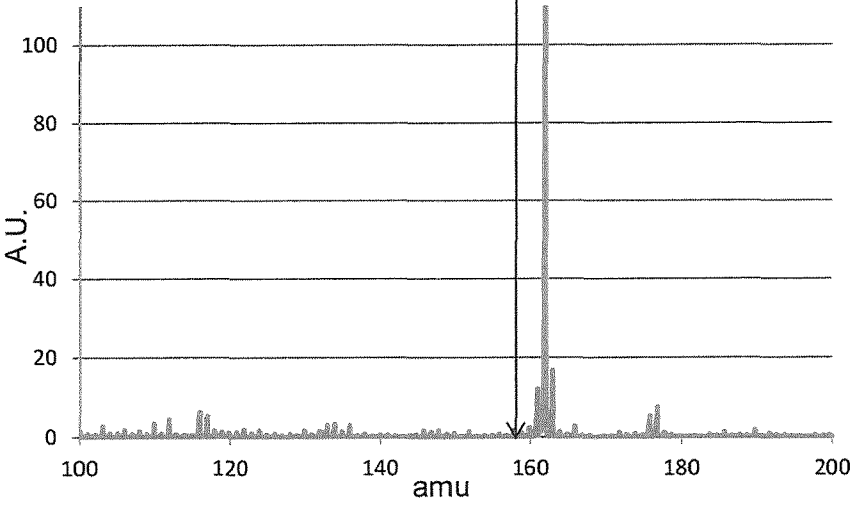

It is noted that, with the commercial capillary, a peak for nicotine is observed for each puff; however, as the temperature of the capillary is increased, a mass peak at 158 amu begins to appear (presumably associated with nicotine fragmentation). At 225° C., no such signal is evident; however, at 240° C., 250° C., and 260° C., the signal at 158 amu becomes increasingly apparent, with the signal at 158 amu being present at an intensity of 50% that of the parent peak at 162 amu at a capillary temperature of 260° C. This fragmentation signal is depicted in FIG. 6A, which was recorded using an instrument with the standard capillary tubing. FIG. 6B was recorded using an instrument comprising alternative capillary tubing (and notably depicts little to no fragmentation signal at 158 amu). Additionally, at 260° C., the instrument employing the commercial capillary gives a spectrum showing undesired fragmentation signals at 72, 58, and 42 amu which substantially disappear when the commercial capillary is placed with the alternative capillary.

Figure 7A:
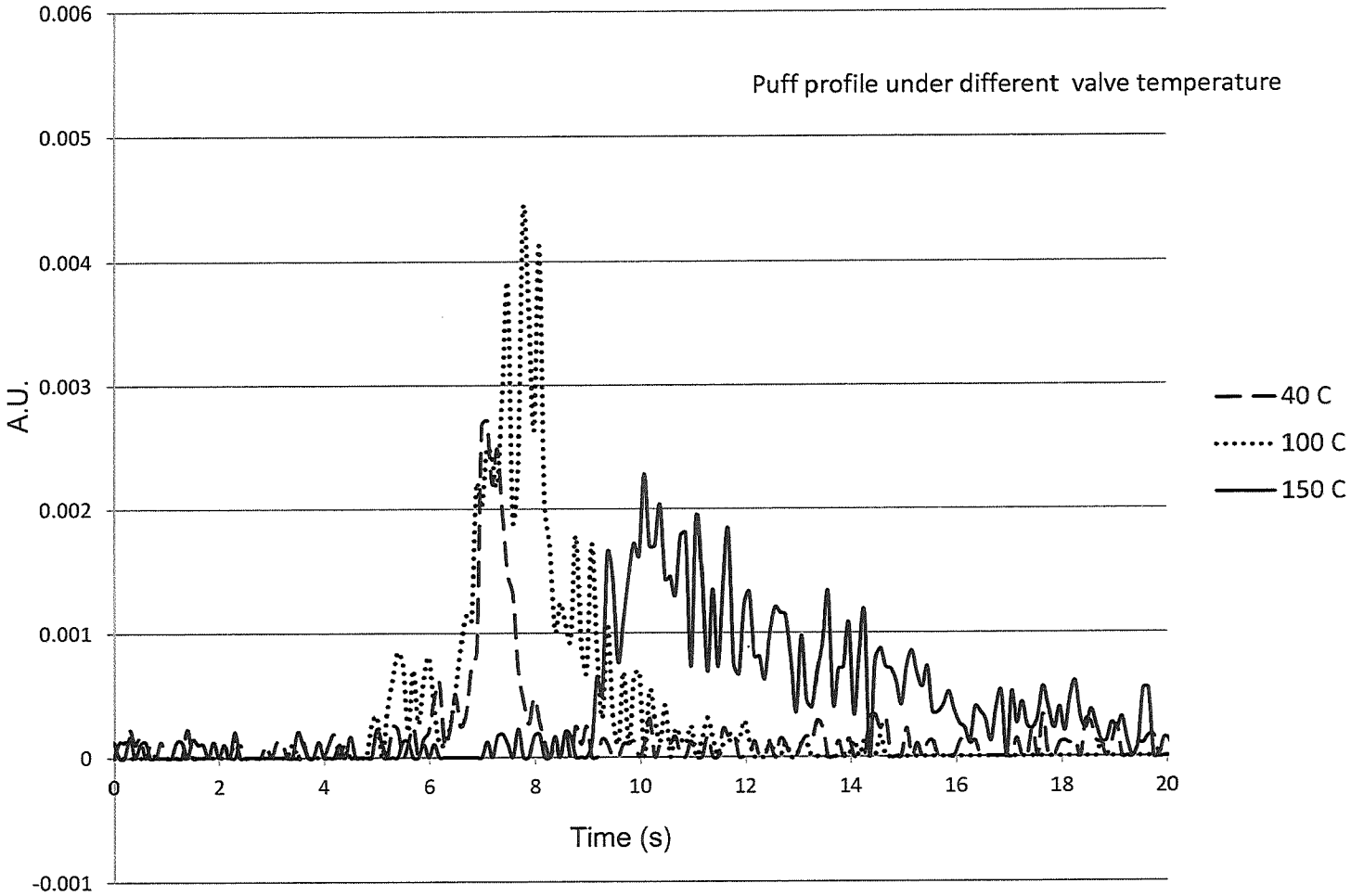
FIGS. 7A and 7B compare the nicotine signal obtained from a puff from an electronic cigarette, on a traditional instrument (A) and on an instrument containing an alternative capillary tube (B), operated at different transfer valve temperatures.
Figure 7B:
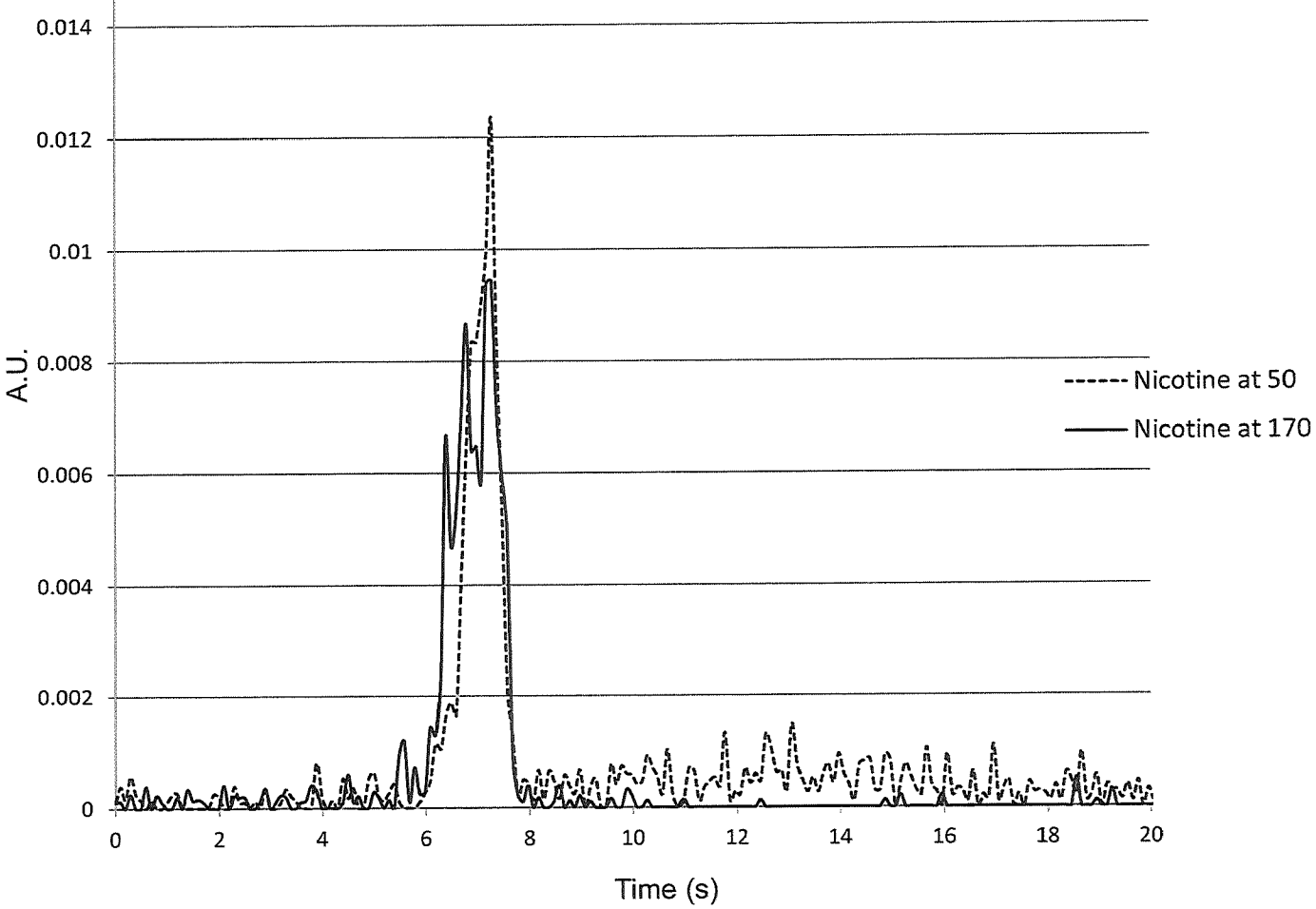

To evaluate the effect of the capillary tubes at different transfer valve temperatures, puff spectra at different transfer valve temperatures were obtained (focusing on the nicotine signal, with capillary temperature set at 250° C.). The puff parameters from the smoking machine are set to 55 mL per 3 seconds, with 2 puffs per minute. With the commercial capillary, the observed puff spectrum exhibits dramatic temperature-dependent broadening associated with the transfer valve. As shown in FIG. 7A, at 40° C., the nicotine puff width is narrow (around 1 second), at 100° C., it is somewhat broader (around 2 seconds), and at 150° C., it is even broader (around 6 seconds). The signal strength is also observed to decrease as the temperature increases in such embodiments. In comparison, with the alternative capillary, the transfer valve temperature-related puff broadening was eliminated. As shown in FIG. 7B, at temperatures as high as 170° C., there was no significant observed puff broadening (with the puff exhibiting a well-defined nicotine peak with a width around 2 seconds and good signal to noise ratio). Signal increase for both nicotine and glycerin can be observed in certain embodiments employing the alternative capillary. Another analysis, conducted using puff parameters from the smoking machine set to 55 mL per 2 seconds, with 2 puffs per minute, corroborated these results. With the transfer valve temperature set at 50° C. and 170° C., the puff spectra using the alternative capillary displayed similar peak widths of between about 1.5 and about 1.8 seconds and similar intensities at the two temperatures.

Figures 8A, 8B:
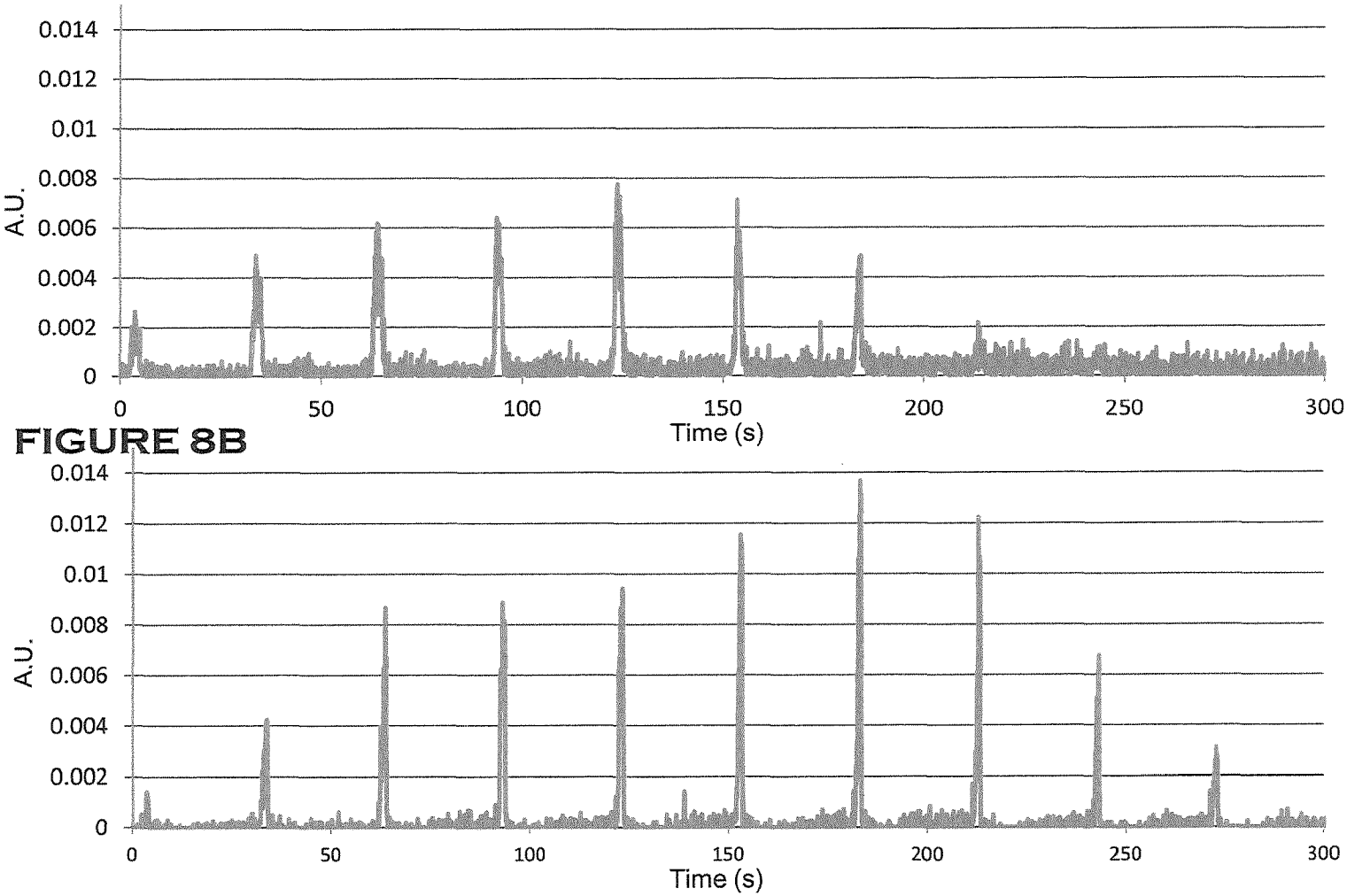
FIGS. 8A and 8B compare nicotine signals over time obtained from repeated nicotine puffs from an electronic cigarette, on a traditional instrument (A) and on an instrument containing an alternative capillary tube (B)

The nicotine puff spectrum of an electronic cigarette was then evaluated over time to compare the effects of the capillaries. As shown in FIGS. 8A and 8B, the biggest puff intensity exhibited using the standard capillary (FIG. 8A) was about 0.008 A.U., whereas the biggest puff intensity exhibited using the alternative capillary (FIG. 8B) was about 0.014 A.U. (at least an 80% signal increase). The puff to puff baseline is also cleaner when employing the alternative capillary. The glycerin puff spectra with the two capillaries were also compared and, using the standard capillary, a relatively low glycerin signal (around 0.002 A.U.) and a broad puff peak width (over 8 seconds) was observed, whereas with the alternative capillary, a significantly higher glycerin signal (around 0.012 A.U., a factor of 6 increase) and a narrower puff peak (around 1.7 seconds) were observed.

Example 3

To evaluate the effects of a second PID lamp incorporated within a mass spectrometer as described in Example 2 (comprising a first PID lamp and an alternative capillary), a second PID lamp is incorporated as generally depicted in FIG. 2 (ionization source 28). Both lamps comprise 10.8 eV VUV PID lamps. Specifically, the first lamp is in high vacuum (inside the chamber) and the second lamp is in air (outside the chamber). The second lamp is mounted on a self-centered kinematics mount, positioned outside the TOF chamber. A viewport is modified to hold a plano-convex $MgF_2$ lens (with 150 mm focal length).

Figure 9:
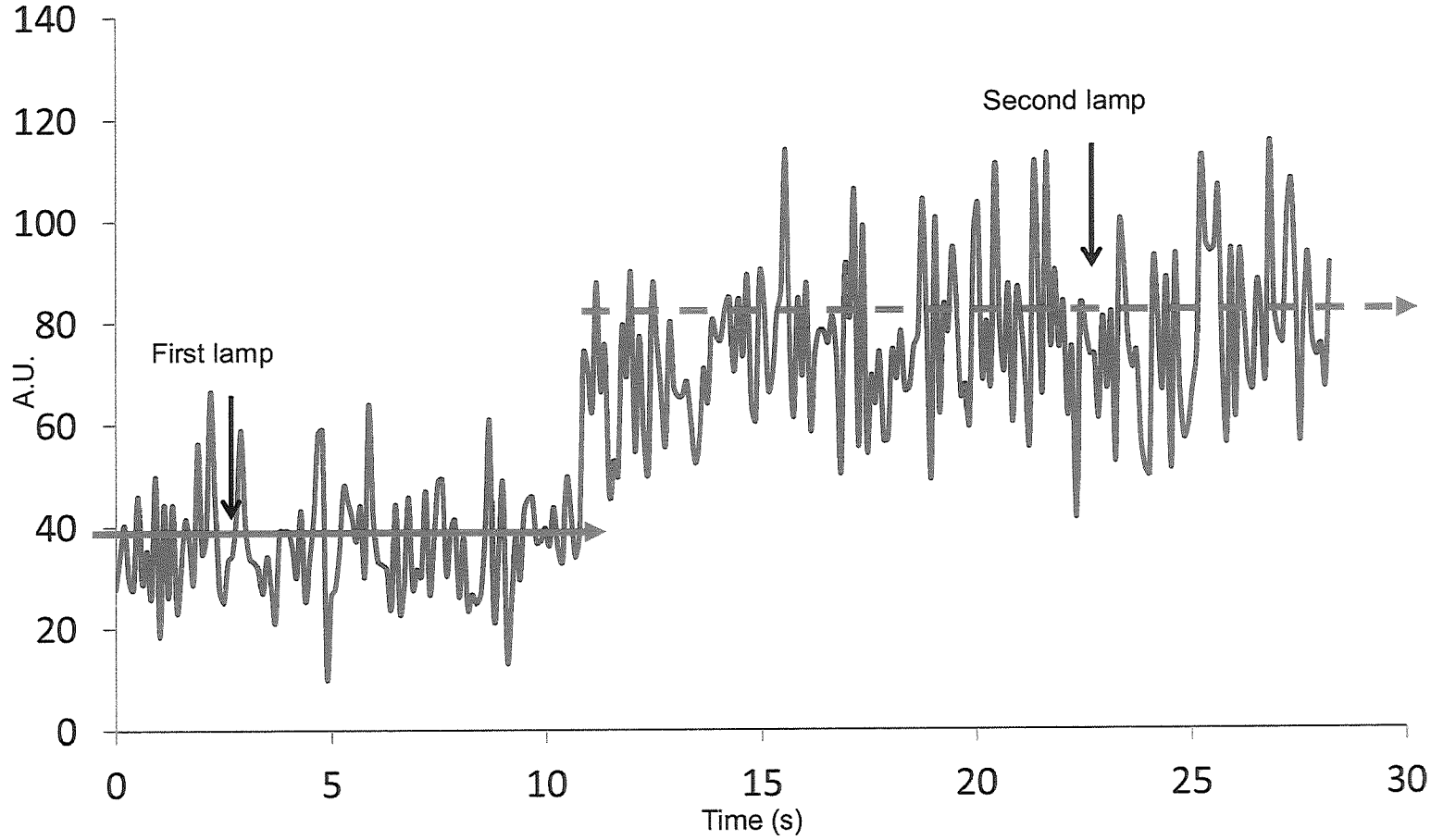
FIG. 9 is a plot of signal level (ion counts) over time showing the improvement in signal level as a second lamp is introduced to a single lamp spectrophotometer.

FIG. 9 provides signal data over time for 100 ppm toluene gas in $N_2$ (wherein the y axis represents the relative signal level of the toluene ion and the x axis represents time (in seconds). As shown, the implementation of two PID lamps as ionization sources provides a 100% signal increase as compared to using a single PID lamp (e.g., as described in Example 1).

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A mass spectrometer comprising:

a sample inlet, an ionization source, comprising a photoionization detector lamp, a mass analyzer, an ion detector, and a second ionization source comprising a second photoionization detector lamp, wherein one photoionization detector lamp is within a vacuum environment and wherein one photoionization detector lamp is not within a vacuum environment.

2. The mass spectrometer of claim 1, wherein the mass analyzer comprises a time of flight analyzer.

3. The mass spectrometer of claim 1, wherein the photoionization detector lamp emits vacuum ultraviolet radiation.

4. The mass spectrometer of claim 1, wherein the photoionization detector lamp is a krypton discharge lamp.

5. The mass spectrometer of claim 1, wherein the photoionization detector lamp has a photon energy of between about 10 and about 11 eV.

6. The mass spectrometer of claim 1, wherein the photoionization detector lamp has a photon energy of about 10.8 eV.

7. The mass spectrometer of claim 1, further comprising a $MgF_2$ window through which radiation from the photoionization detector lamp passes.

8. The mass spectrometer of claim 1, wherein the photoionization detector lamp comprises a $MgF_2$ window.

9. The mass spectrometer of claim 1, further comprising an o-ring sealing the photoionization detector lamp to a flange connected to a portion of the mass spectrometer.

10. The mass spectrometer of claim 1, wherein a detection sensitivity for a given compound is at least 5 times a comparative detection sensitivity for said compound using a comparable mass spectrometer wherein the ion detector comprises an electron beam pumped argon lamp of the same wavelength and same photon energy.

11. The mass spectrometer of claim 1, wherein a detection sensitivity for a given compound is between about 5 times and about 30 times a comparative detection sensitivity for said compound using a comparable mass spectrometer wherein the ion detector comprises an electron beam pumped argon lamp of the same wavelength and same photon energy.

12. The mass spectrometer of claim 1, having a signal to noise ratio is higher than a comparative signal to noise ratio of a comparable mass spectrometer wherein the ion detector comprises an electron beam pumped argon lamp of the same wavelength and same photon energy.

13. The mass spectrometer of claim 1, wherein both photoionization detector lamps emit vacuum ultraviolet radiation.

14. The mass spectrometer of claim 1, wherein both photoionization detector lamps are krypton discharge lamps.

15. The mass spectrometer of claim 1, wherein both photoionization detector lamps have a photon energy of between about 10 and about 11 eV.

16. The mass spectrometer of claim 1, wherein at least one of the photoionization detector lamps comprises a $MgF_2$ window through which radiation from the photoionization detector lamp passes.

17. The mass spectrometer of claim 1, wherein the signal produced from the mass spectrometer is at least two times that produced from a comparable mass spectrometer comprising a single ionization source.

18. The mass spectrometer of claim 1, further comprising a smoking instrument in-line with the spectrometer, wherein smoke or vapor produced within the smoking instrument is in fluid communication with the sample inlet of the mass spectrometer.

19. A method of analyzing aerosolized or vaporized compounds, comprising:

providing a sample in gaseous form;

introducing the sample in gaseous form into a mass spectrometer comprising:

a sample inlet, an ionization source comprising a photoionization detector lamp, a mass analyzer, an ion detector, and a second ionization source comprising a second photoionization detector lamp, wherein one photoionization detector lamp is within a vacuum environment and wherein one photoionization detector lamp is not within a vacuum environment; and detecting the presence of one or more compounds in the sample based on output from the ion detector.

20. The method of claim 19, wherein the aerosolized or vaporized compounds are produced from a smoking article or electronic smoking article.

21. The method of claim 19, wherein both photoionization detector lamps emit vacuum ultraviolet radiation.

22. The method of claim 19, wherein both photoionization detector lamps are krypton discharge lamps.

23. The method of claim 19, wherein the mass analyzer comprises a time of flight analyzer.

24. The method of claim 19, wherein the one or more compounds in the sample are selected from the group consisting of nicotine and organic acids.

25. The method of claim 19, wherein the detecting step achieves a detection sensitivity for the one or more compounds in the sample that is at least 5 times the detection sensitivity for said one or more compounds using a comparable mass spectrometer wherein the ion detector comprises an electron beam pumped argon lamp of the same wavelength and same photon energy.

26. The method of claim 19, wherein the detecting step achieves a detection sensitivity for the one or more compounds in the sample that is between about 5 times and about 30 times the detection sensitivity for said one or more compounds using a comparable mass spectrometer wherein the ion detector comprises an electron beam pumped argon lamp of the same wavelength and same photon energy.

27. The mass spectrometer of claim 19, wherein the signal produced from the mass spectrometer is at least two times that produced from a comparable mass spectrometer comprising a single ionization source.

* * * * *